US005813800A

United States Patent [19]

Doleshal

[11] Patent Number: 5,813,800

[45] Date of Patent: Sep. 29, 1998

[54] PROCESS FOR REPLACING AND LOADING A DAMAGED SECTION OF A PILE

[76] Inventor: Donald L. Doleshal, 31460 W. 135Th St., Olathe, Kans. 66061

[21] Appl. No.: 610,305

[22] Filed: Mar. 4, 1996

[51] Int. Cl.[6] ..... E02D 5/64; E02D 7/00; E02D 11/00

[52] U.S. Cl. ..... 405/232; 405/244; 405/250; 405/251

[58] Field of Search ..... 405/232, 244, 405/250, 251

[56] References Cited

U.S. PATENT DOCUMENTS

| | | | |
|---|---|---|---|
| 1,005,693 | 10/1911 | Clark | 405/248 |
| 2,222,481 | 11/1940 | Ferguson et al. | 405/250 |
| 2,451,777 | 10/1948 | Salas | 405/230 |
| 3,180,099 | 4/1965 | Mikolajczyk | 405/216 |
| 3,934,422 | 1/1976 | Fredrickson et al. | 52/514 |
| 4,070,867 | 1/1978 | Cassidy | 52/170 |
| 4,097,165 | 6/1978 | Quayle | 52/514 |
| 4,117,637 | 10/1978 | Robinson | 52/167 |
| 4,765,777 | 8/1988 | Gregory | 405/230 |
| 4,948,301 | 8/1990 | Geffrliaud et al. | 405/244 |
| 5,336,021 | 8/1994 | Freeman, III | 405/230 |
| 5,492,437 | 2/1996 | Ortiz | 405/232 X |

*Primary Examiner*—Tamara L. Graysay
*Assistant Examiner*—Tara L. Mayo
*Attorney, Agent, or Firm*—Kenneth W. Iles

[57] ABSTRACT

Damaged sections of existing piles are replaced with a replacement pile section that includes various segments, including a jack section for sizing and preloading the replacement pile section to original design loads and strengths. The replacement pile section includes at least one coupler having a jack section, which includes a jack for applying a design load to the pile and a plurality of jack screws that are adjusted to accept the design pile load; the hydraulic jack is removed through an access opening, so that the jack screws carry the load; the cavity in the jack section is filled with grout, such as concrete through the access opening, which is then sealed. Other sections of the replacement pile section include, for example, intermediate pile sections, shock absorbing sections, and additional couplers. An alternative embodiment employs two or more balanced hydraulic jacks bearing against external jack flanges fastened to the pile above and below the replaced section.

16 Claims, 7 Drawing Sheets

PROCESS FOR REPLACING AND LOADING A DAMAGED SECTION OF A PILE

BACKGROUND OF THE INVENTION

1. Field of the Invention

The present invention is directed to an apparatus and process for replacing a damaged section of a pile. More particularly, the present invention is directed to an process for replacing a damaged section of a pile by splicing, whether the pile is submerged or on land, regardless of the material the pile is made from, and applying a predetermined load to the repaired pile, thereby allowing the repaired pile to support the original design load and to absorb compressive and lateral forces without compromising the support afforded to a structure supported by the pile.

2. Description of Related Art Including Information Disclosed Under 37 C.F.R. Sections 1.97–1.99

Piles are commonly used to support structures such as buildings, docks, piers, and the like where the soil is unstable or is covered by water, or where valleys or ravines must be bridged, as for railroad trestles. Frequently, certain sections of piles deteriorate faster than other sections. Common practice is to replace an entire pile when only a portion of it is damaged. This is very expensive, as piles can commonly be 150 feet long and cost $50.00 per foot simply for driving them into the soil.

Submerged piles, commonly used to support piers and other structures above the water line, are subject to serious degradation in the splash zone, that is, a zone from about 20 feet below the mean water level up to the highest area that water normally reaches during high tides or storms. The high level of oxygen dissolved in water in the splash zone allows marine organisms to attack piles, as well as facilitating corrosion. The effect is found in both fresh water and salt water, although it is more pronounced in salt water environments. Piles may also be subject to damage from being struck by boats or ships and the like. Such actions damage only a relatively short span of a pile, but frequently the entire pile is replaced.

Piling also experiences various forms of deterioration in the atmospheric zone, which is the area that is not surrounded by either some type of earthen material or submerged in water. For piles driven through water, this portion of a pile is above the splash zone. Deterioration can be caused by various conditions that may be specific to a particular geographic location of the pile. These conditions include an array of environmental attacks such as rusting, abrasion, ultra violet light, air pollution (for example, ground level ozone, sulfuric gases, acid rain, and the effects of continual freeze and thaw cycles, to list a few).

Structural degradation of a pile may also be attributed to excessive loading of the pile in many instances. Excessive loading of one or more piles may cause cracking or other physical damage. Excessive loading of properly designed and installed piling may result from shifting or settling of the underlying supporting soil, or from changes in the load applied by the supported structure.

Vibration is also a factor in pile deterioration, as is the added stress of a load passing over head and the vibration this causes. These factors are a special concern in railroad trestles, for example. In certain geological zones, vibration and shifting may be caused by earthquakes and the following aftershocks.

All of these stresses and others commonly cause serious degradation to a relatively short section of one or more piles and, when a certain number of piles have deteriorated to a certain extent, the ability of the piling to adequately support the designed structure or load is seriously compromised and repairs must be undertaken.

In the prior art the damaged section of the pile is removed and is sometimes replaced by a treated pile butt. The joints are simply the squared off ends of the existing pile and of the butt pile. Both the upper and lower joints are reenforced by treated timber fish plates, that is, a sleeve that covers the joint and some area above and below the joint. This process does not provide good lateral stability, which may be achieved by fixing "X" braces between piles to be laterally stabilized. A load is applied to the piles by inserting a replacement pile section of approximately the correct length and then shimming the space between the top end of the replacement pile and the supported structure. Such shimming does not readily permit loading of the pile to the original design specifications. This method would not appear to work with hollow steel piles.

Therefore, there is a need for a proces and apparatus for replacing a damaged pile section and preloading the resultant repaired pile that permits replacement of only a damaged section of a pile; that is significantly less expensive than replacement of the entire pile; that easily allows preloading of the pile to design specifications; that provides a permanent design load bearing capacity; that provides substantial lateral stability; that can be applied to piles made from any type of material and which are located in any type of environment, for example, submerged or above the water or soil line.

SUMMARY OF THE INVENTION

Accordingly, it is a primary object of the present invention to provide a process and apparatus for the replacing and loading of a damaged section of a pile that permits replacement of only a damaged section of a pile.

It is another object of the present invention to provide a process and apparatus for the replacing and loading of a damaged section of a pile that is significantly less expensive than replacement of the entire pile.

It is another object of the present invention to provide a process and apparatus for the replacing and loading of a damaged section of a pile that easily allows preloading of the pile to design specifications.

It is another object of the present invention to provide a process and apparatus for the replacing and loading of a damaged section of a pile that provides a permanent design load bearing capacity.

It is another object of the present invention to provide a process and apparatus for the replacing and loading of a damaged section of a pile that provides substantial lateral stability.

It is another object of the present invention to provide a process and apparatus for the replacing and loading of a damaged section of a pile that can be applied to piles made from any type of material and which are located in any type of environment, for example, submerged or above the water or soil line.

The purpose of this invention is to replace a damaged section of a pile economically without compromising the strength of the pile or the structural integrity of the structure supported by the piles. The damaged section of a pile to be replaced is removed from the pile and the remaining upper and lower ends are dressed by squaring off, tapering, or the like and a coupler section is fitted onto each butt end and secured thereto by a plurality of locking rods that are screwed into bolts welded to the outside of the coupler.

A spacer pile replacement, pile section, which may be any desired length, is prepared and inserted into the gaps between the ends of the existing pile, along with other sections that perform various functions, for example, a jack section for preloading the replacement pile section, or a shock absorbing section, and so forth, as described below. The entire structure of the spacer pile section, jack section, coupler section or sections, shock absorbing section, and so forth, in whatever order they are assembled, constitutes a replacement pile section. Alternatively, the damaged pile replacement section may extend to the supported structure itself. In this case, there will be only a single lower section of the damaged pile.

A jack section is inserted at any convenient joint between any of two system elements, for example, between the replacement pile section and the supported load; between the upper butt end of the damaged pile and the replacement pile section, and so forth. Any type of jack having the required motive force may be used, for example, a screw jack (for small jobs), a hydraulic jack or ram, or the like.

The jack is set into the jack section so that the piston's direction of travel coincides with the lines of compressive force that the pile will be subject to, which are typically vertical, but need not be (for example, trestles). This eliminates the shifting that may occur in other systems that employ a jack off to the side of the pile, which develops a significant lateral force component when the jack is activated, but entirely removes that lateral force when the jack is lowered. A force sensor is placed between the jack and the pile to be loaded, with a remote readout that allows the worker to measure and observe the actual load being imposed on the repaired pile. When the desired loading force is achieved, the piston of the jack is fixed in place. The repaired pile is then stabilized by installing a plurality of screw pins parallel to the lines of compressive force, and these pins are adjusted in length, thereby providing sufficient strength to hold the pile in place with the desired loading. The jack is then removed through an access plate on the jack section, an important consideration because jacks capable of lifting significant loads are expensive. Then the jack section and the gap between the pile joints and the replacement pile sections and the existing pile section(s) are filled with concrete. This process provides a permanent replacement section that can be designed to bear the same load as the original pile or a greater load.

Certain shock absorbing elements, such as a solid rubber or rubber-like compound, a compression spring, a hydraulic fluid flow shocker absorber, or the like provide shock and vibration absorption that insulates the supported structure from shock and vibration and is especially useful in areas that are prone to earthquakes.

Further, a replacement and preloading system according to the present invention may be used with a pile having any shape of cross section, for example, circular, hexagonal, H-piles, square, and so forth. This process also allows replacement of a damaged pile section with a different material. For example, a concrete replacement section can be used with a wood pile; a steel replacement section can be used with a wood, steel, or concrete pile, and so forth.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
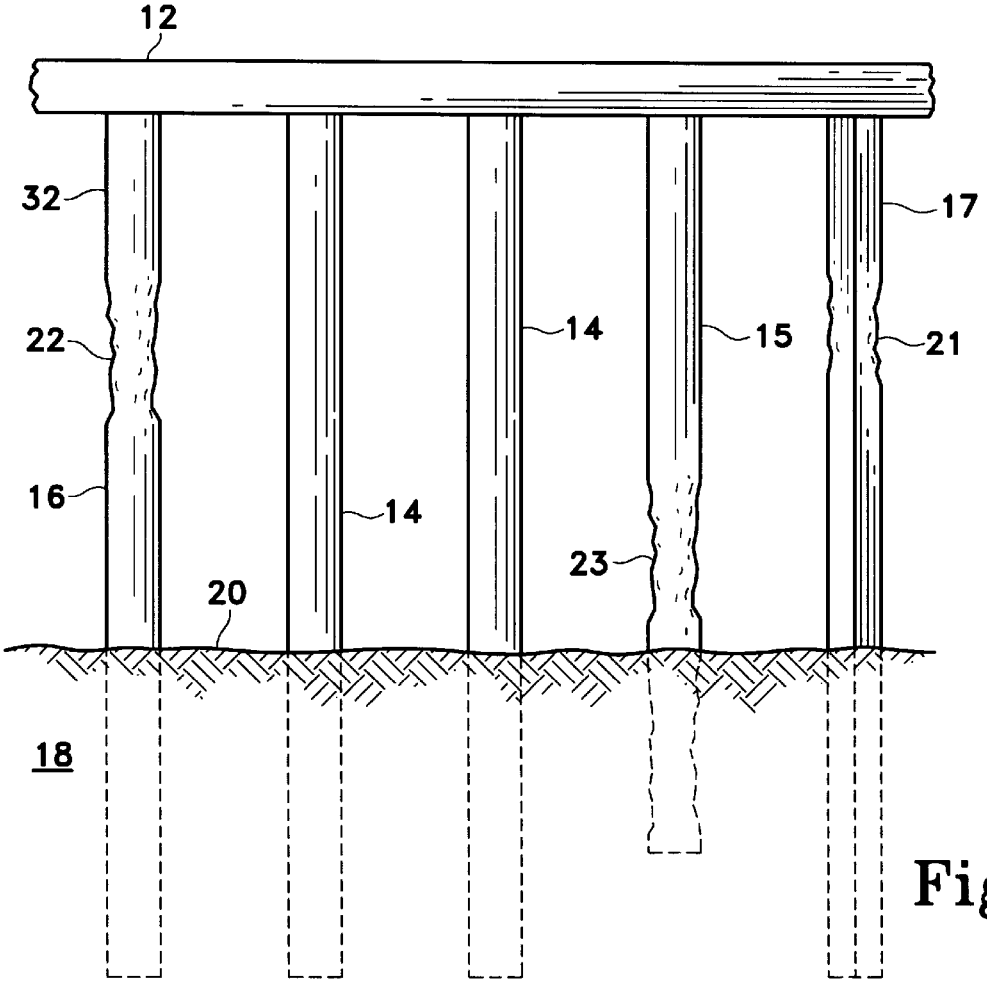
FIG. 1 is a side elevation of load supporting piling supporting a structure and showing two piles with a damaged section that compromises the pile's load bearing ability.

Referring to FIG. 1, a pile cap 12, or such as a pier, building or other structure, is supported by a plurality of piles 14, 15, 16 which have been driven into the soil 18 to some predetermined depth and which support the pier 10 above the soil line or mud line 20. A damaged pile 16 includes a deteriorated section 22 above the soil or mud line 20 that comprises the ability of the pile 16 to support its intended design load, thereby compromising the load bearing capacity and stability of the pile cap 12 and piling 14 system. The pile 15 includes a deteriorated section 23 extending from above the soil or mud line 20 to some depth below it, compromising its strength. A rectilinear pile 17 having a square cross-section and a damaged or deteriorated section 21 as shown in FIG. 1 can be repaired in the same manner and with the same results as the cylindrical piles 14, 15, 16 as discussed below.

The piles 14, 15, 16, 17 may be of any length and may have been driven into the soil 18 to a depth of hundreds of feet, especially in the case of a building supported on piles. In this type of construction, the lower edges of the walls may be near or in contact with the soil line 20 and the supporting piles entirely obscured from view. The apparatus and process described herein can be as well employed in this case as when the pile cap 12 is above the soil line 20, as shown in FIG. 1. The only additional step required in such a case is a little excavation.

Upon installation, a pile 14, 15, 16, 17 will support a certain load, which increases substantially after the sea bed settles. The piles buried in the sea floor form a foundation and any type of structure can be placed on it, including pile sections or extensions made from a material that is different than the material the original piles are made from. For example, steel pile sections may be seated upon and fixed to wooden piles below them. Typically, the live load, or working load, of a pile system is eight times the dead load. That is, a dock supported on piles is typically designed to hold eight times its own weight. This means that, in most cases, the total number of piles to be repaired may have their damaged sections removed at one time, prior to any replacement of a repair section, without endangering the stability of the dock or other supported structure.

Figure 2:
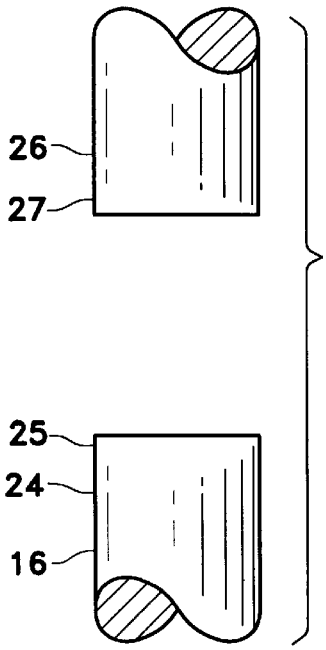
FIG. 2 is an enlarged side elevation of a portion of a damaged pile from FIG. 1 following removal of the damaged section and dressing of the ends of the remaining pile by squaring off.

Referring to FIG. 2 the damaged sections 22, 23, 25 of the pile 15, 16, 17 are removed by cutting and the remaining lower end 24 of the existing pile 15, 16, 17 are dressed by squaring off the end of the lower end 24, and likewise squaring off the upper end 26 to provide squared butt ends 25, 27, respectively. It is important to note that one or more of the damaged piles can have their damaged sections removed prior to installation of a replacement pile section. There is great flexibility in determining the number and layout of the particular piles whose damaged sections are removed before any replacement pile is installed, including removal of all damaged sections prior to any replacement, so long as the remaining piles can adequately support the dead load on the pile system. This allows for specialized work crews, a damaged section removal crew, and a pile replacement crew.

Figure 3:
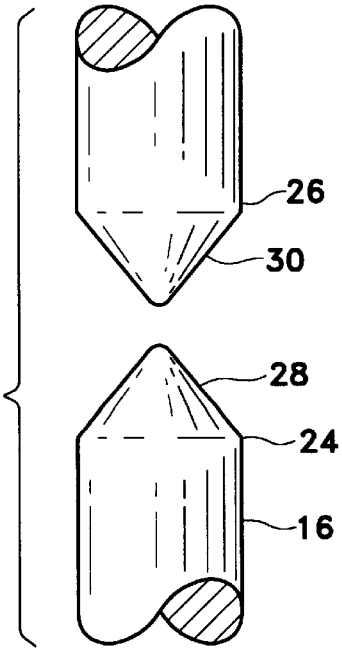
FIG. 3 is a side elevation of an alternative style of dressing the ends of the existing pile following removal of the damaged section.

Alternatively, as shown in FIG. 3, the lower end 24 and the upper end of the existing pile 26 are formed into conical butt ends 28, 30 to provide a greater surface area and greater lateral stability when mated with mating ends of a replacement pile section. Other styles of butt end dressing may also be employed, such as a tongue dressing for setting in a mating groove in the replacement section butt end. In some instances, it may be desirable or necessary to remove the upper pile section 32 above the damaged section 22 of the existing pile 16, all the way up to the structure 12, and likewise with pile 15. In this case, there will be no upper butt end 26 and the replacement apparatus described below will directly support the pile cap 12.

Figure 4:
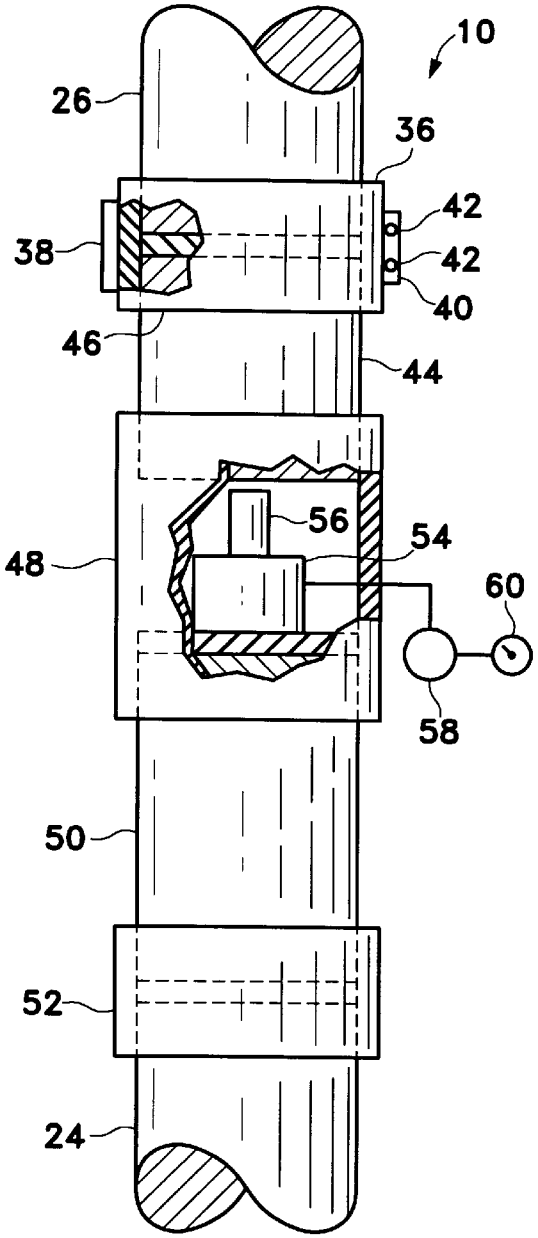
FIG. 4 is a side elevation of the apparatus for replacing a damaged section of a pile after dressing the ends and loading the pile, comprising, from the top to bottom, the upper butt end of the existing pile, an upper coupler for connecting the upper butt end of the existing pile to an upper replacement pile section; an upper replacement pile section; a jack section; a lower replacement pile section; a lower coupler fastened to the lower pile replacement section; and the lower butt end of the dressed existing pile, also fastened to the lower coupler section.
Figure 16:
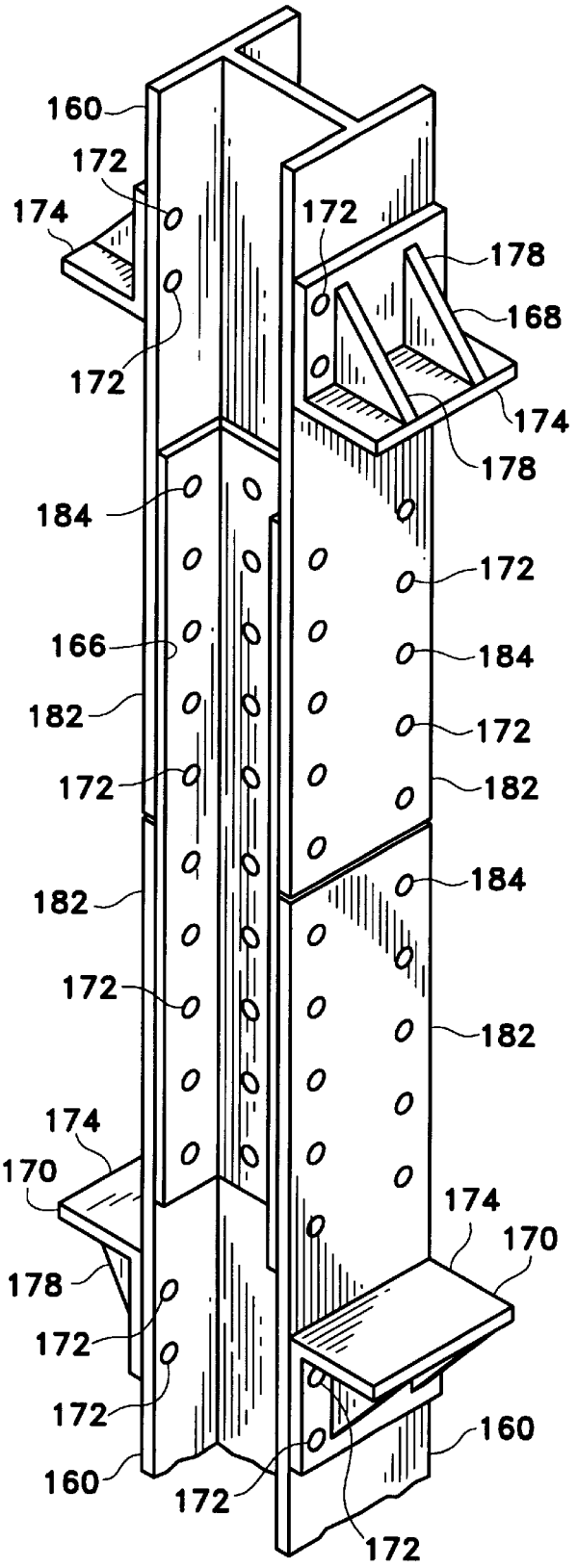
FIG. 16 is a front elevational perspective view of a H-pile prepared for replacement according to the present invention.
Figure 17:
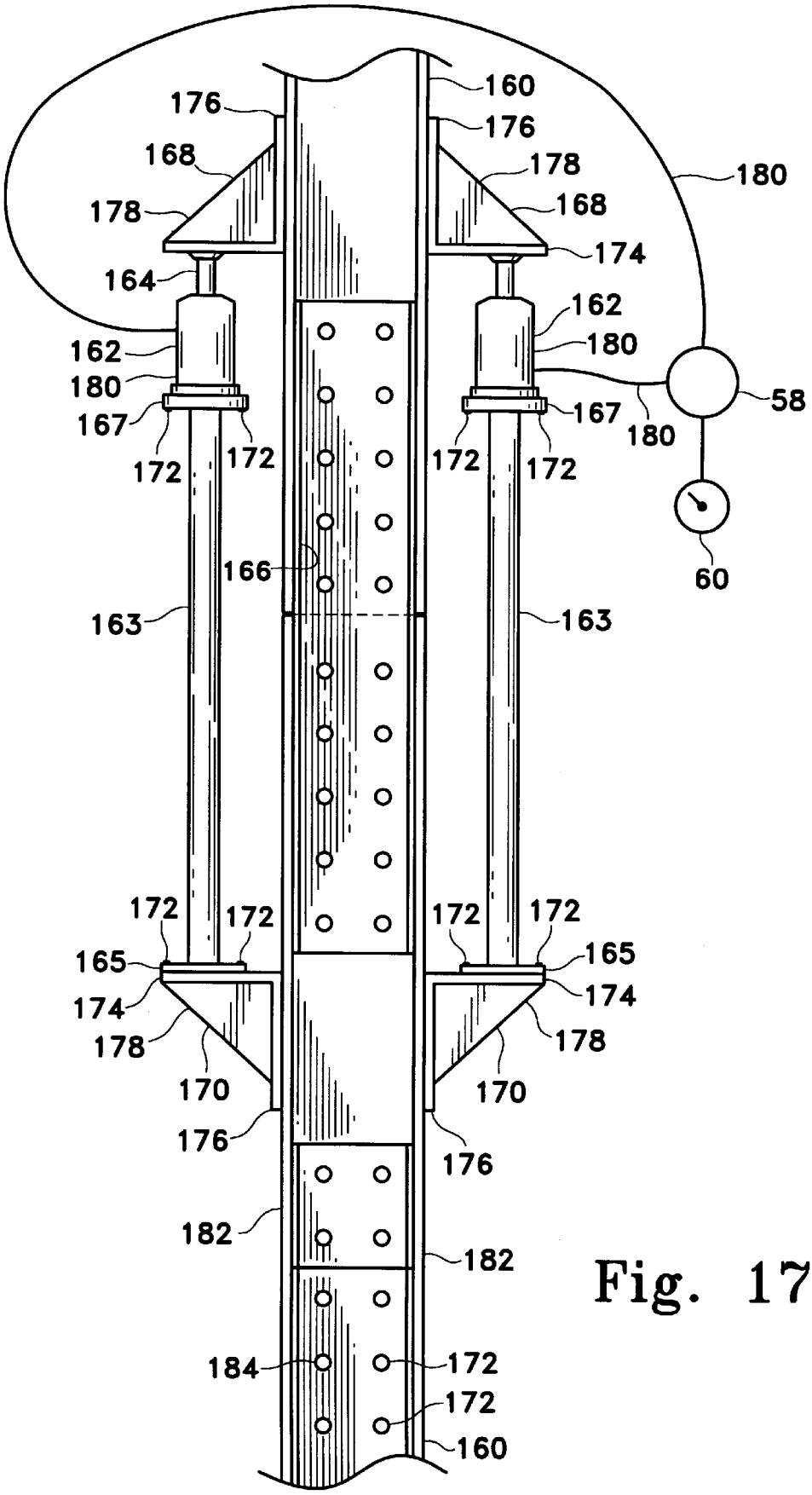
FIG. 17 is an elevation of an alternative embodiment of the present invention having jacks external to the pile.

Referring now to FIG. 4, a replacement pile section 10 has been assembled between the lower end 24 and the upper end 26 of the existing pile 15, 16, 17 after removing the damaged pile section 22, or 23 and squaring off the ends 24, 26 as shown in FIG. 2. The replacement pile section 10 includes a coupler 52, of which an upper coupler 36 is a special case, having a longitudinal hinge 38 and a pair of flanges 40 that come together when the upper coupler 36 is closed, as shown in FIG. 4, and are fastened together by bolts and nuts 42. An upper spacer pile 44 is fixed into a lower section 46 of the upper coupler 36 and into a jack section 48, which fits over a lower spacer pile section 50, which in turn fits into a lower coupler 52, which fits over and is secured to the lower end 24 of the existing pile 15 or 16. These system elements 36, 44, 48, 50 and 52 are fastened together into a single assembly replacement pile section 10 on the shore or pile cap 12 and are then lowered directly onto the lower end 24 of the damaged pile 16. In some cases, the physical constraints will prevent the entire length of the replacement pile section 10 from being placed on the lower end 24. For example, the pile cap 12 may not allow enough clearance. In this case the optional hinge arrangement on the upper coupler 36 allows the upper coupler 36 to swing open 180 degrees, thereby allowing use of a replacement pile section that is very nearly the total length required to replaced the damaged pile section 22, 23. Each of these system elements is secured to the adjacent element by a system of locking rods, as described below (FIGS. 16, 17). A hydraulic jack or ram 54 includes a motive piston 56, which is driven by a hydraulic motor 58, having a force sensor 60 that derives the upward force exerted on the piston 56 from the force applied to the jack 54 and system parameters, thereby allowing an operator to apply a predetermined design load to the pile 15, 16 and the replacement pile section 10. This allows the repaired pile to be al least as strong as the original pile, meeting design specifications for compression, stress, strain, shear, torque, and lateral forces from, for example, impacts from boats and ships, waves, earthquakes, and so forth.

Figure 5:
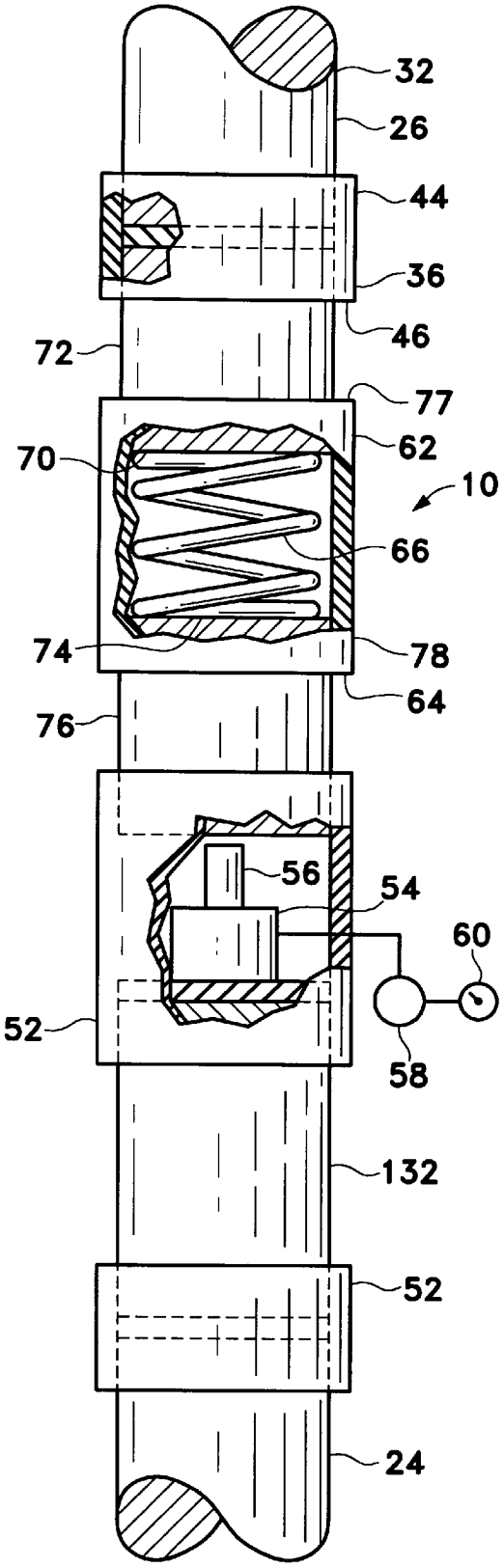
FIG. 5 is a side elevation, partially in section, of a replacement pile section according to the present invention, including a shock absorbing section having a coil spring, which is inserted between the upper replacement pile section and the jack section of FIG. 4.
Figure 6:
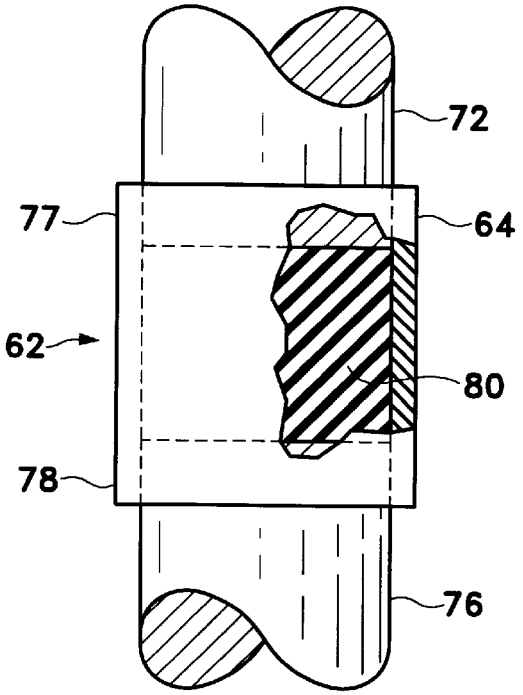
FIG. 6 is an enlarged fragmentary side elevation partially in section showing an alternative embodiment of a shock absorbing section of FIG. 5.
Figure 7:
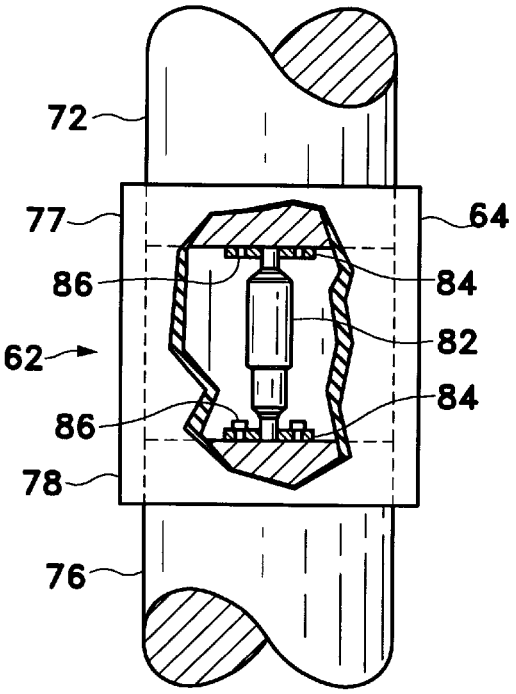
FIG. 7 is an enlarged fragmentary side elevation of another alternative embodiment of a shock absorbing system like FIGS. 5, 6, in which the shock absorbing system is a hydraulic fluid travel shock absorber.

Referring now to FIG. 5, another embodiment of the replacement pile section 10 is shown, which is similar to that shown in FIG. 4, but includes the addition of a shock absorbing section 62, which includes a coupler shell 64, which houses a compression coil spring 66. When a shock absorbing section 62 is employed, it is also assembled dockside as a part of the whole replacement pile section 10. When a coil spring 66 is used, it may be particularly advantageous to use a hinged upper coupler 36 because the spring will be compressed between lower end 70 of the upper intermediate spacer pile section 72 and the upper end 74 of the lower intermediate spacer pile section 76 when the pile 15, 16, 17 is loaded. The coupler shell is held in place on the upper and lower intermediate spacer pile sections 72, 76 by the upward projecting skirt portion 77 and the lower depending skirt portion 78, which have a perimeter that fits the respective upper and lower intermediate spacer pile sections 72, 76 snugly enough to provide lateral support, but loosely enough to allow some compression and elastic rebound of the shock absorbing medium of the shock-absorbing section 62. The shock absorbing medium may be the compression coil spring 66 of FIG. 5, whose rebound may be dampened with a suitable shock absorber such as that shown in FIG. 7, or another type of medium. In an alternative embodiment illustrated in FIG. 6, a shock-absorbing section 62 includes a solid elastic resilient material 80, such as hard cured rubber, that fills the cavity created by the interior of the coupler shell 64 and the upper and lower intermediate spacer pile sections 72, 74. In another alternative embodiment, the shock-absorbing section includes a hydraulic fluid flow shock absorber 82, which is held in place by a bracket 84 at the top and bottom ends of the hydraulic fluid flow shock absorber 82. The brackets 84 are fixed to the upper and lower intermediate spacer pile sections 76, 78 by bolts 86.

Figure 8:
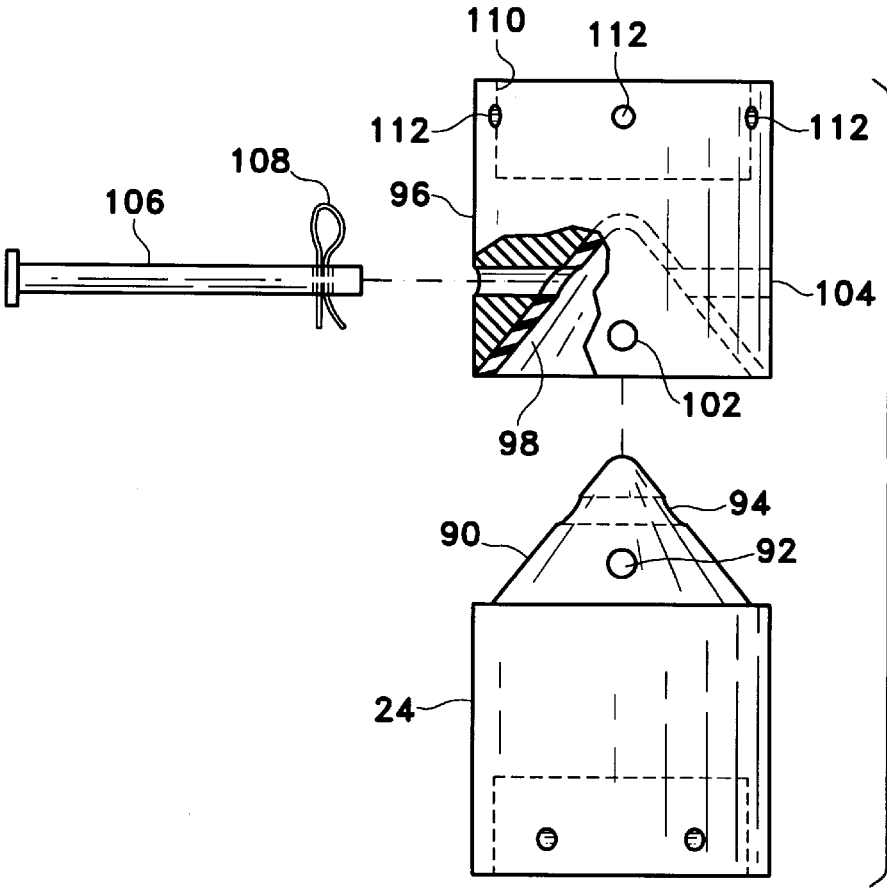
FIG. 8 is a side elevation of an alternative shock absorption and joining system, comprising a shock absorption section having a conical cavity lined with shock-absorbing and receiving a lower butt end of the existing pile that has been dressed to a mating projecting conical end, with both end fittings having one or more bores therethrough for allowing the insertion of a stabilizing pin.

Referring now to FIG. 8, there is shown an alternative shock absorbing system in which the end 24, 26 of an existing pile 14, 15, 16, 17 following removal of a damaged pile section 22, 23, 25 is dressed to a conical butt end 90 and includes a through bore 92 and a detent ring 94. A coupler 96 for accepting the conical butt end 90 includes a conical cavity 98 having a thick lining 100 of hard resilient cured rubber that accepts the conical butt end 90 in a tight fit. A bore 102 aligns with the bore 92 of the conical butt end 90 to accept a pin or bolt through the assembled parts 90, 96. A bore 104 aligns with the detent ring 94 so that a pin 106 inserted through the bore 104, secured by a cotter pin 108, locks the conical butt end 90 into the coupler 96, which includes an upper recess 110 and bolt holes 112 for accepting and securing another pile section. The conical butt end 90 and coupler 96 arrangement of FIG. 8 may be used anywhere that two adjacent structures need to be joined as disclosed herein, for example in any of the replacement pile section 10 structures of FIGS. 4, 5.

Figure 9:
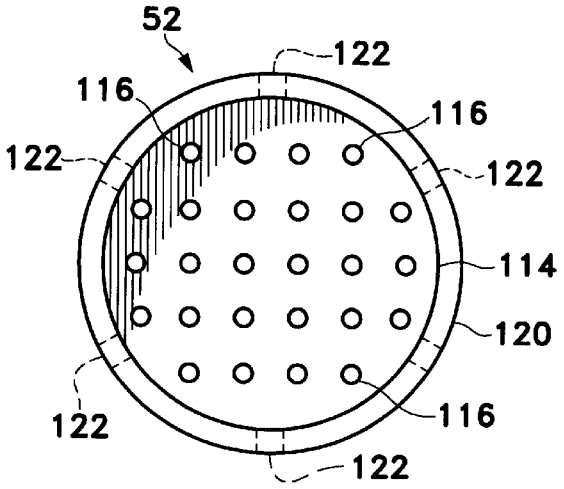
FIG. 9 is a top plan view of a coupler section according to the present invention.
Figure 10:
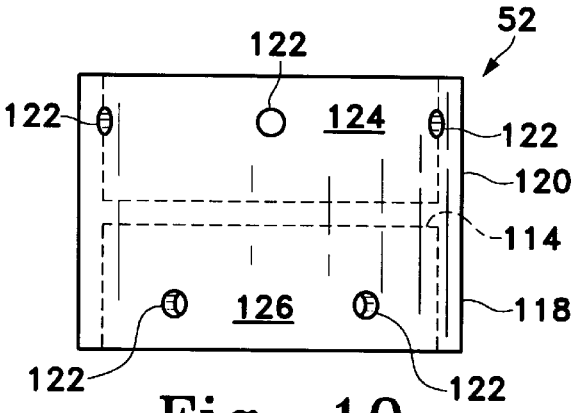
FIG. 10 is an elevation of the coupler section of FIG. 9.
Figure 11:
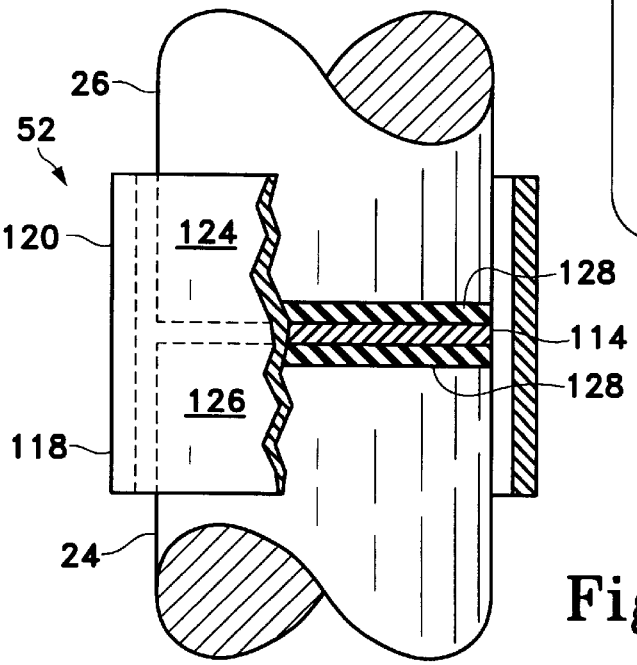
FIG. 11 is an elevation of the coupler section according to the present invention showing the use of cushioning shock-absorbing material to provide shock absorption and improve the friction, and hence, the lateral stability of the joints secured by the coupler.

Referring to FIGS. 9–11, the coupler 52 for a cylindrical pile 14, 15, 16 includes a circular coupling plate 114 having a number of apertures 116 therethrough. A coupler depending skirt portion 118 and a coupler upward projecting skirt portion 120 are formed about the circular coupling plate 114, forming upper and lower pile section receiving cavities 124, 126, respectively. The skirt portions 118, 120 both includes six apertures 122, arranged in pairs, with the apertures 122 in each pair aligned across a diameter of the coupler 52 for allowing a bolt, rod, pin, or the like to be inserted through the coupler 52 and a pile section inserted into the coupler 52, as discussed below. Typically, at least one joint of the replacement pile section 10 will be underwater. Welding steel underwater is difficult at best, so the joints are preferably bolted together as described here. A resilient high friction material such as the rubber disks 128 are inserted into the coupler 52 ends as shown to cushion the pile section ends 24, 26, increase the friction of the fittings and the lateral stability of the resulting joint.

Figure 12:
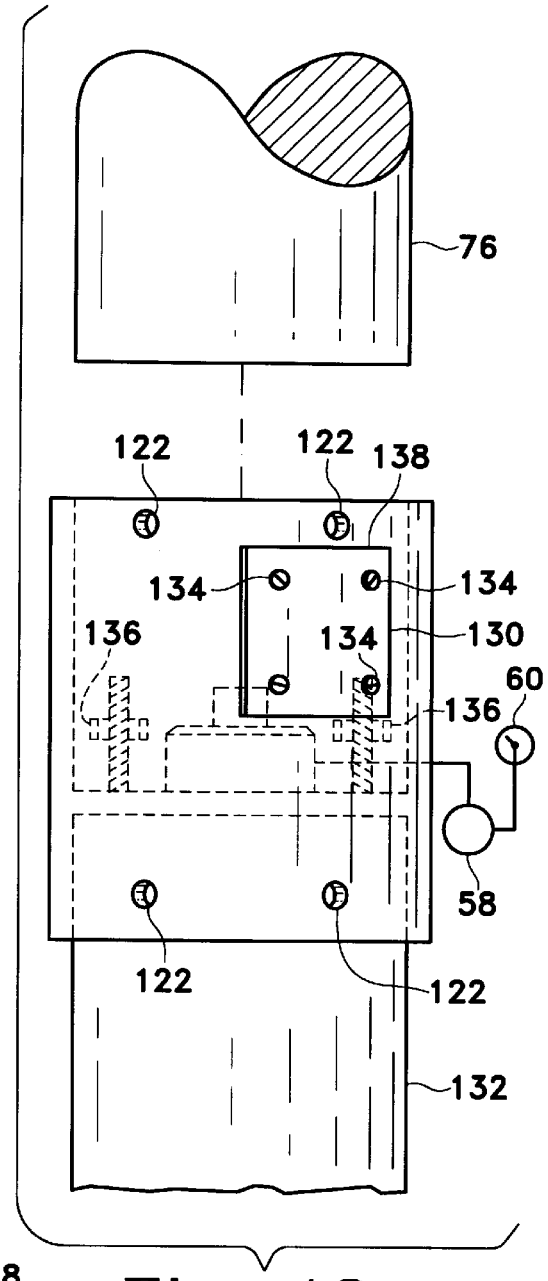
FIG. 12 is an enlarged front elevation of the jack section according to the present invention.

Referring now to FIG. 12, the jack section 48 includes a coupler 52 inside which a hydraulic jack 54 is seated with the motive piston 56 projecting upward. The hydraulic jack 54 simply rests on the upper end of the intermediate spacer pile 132 and is not fixed in place. An access plate 130 is secured to the coupler 52 by screws 134. Three jack screws 136, which are raised or lowered like a turnbuckle, are inserted into the interior of the jack section 48 through the access opening 138, created by removing the plate 130, and then the hydraulic jack 54 is inserted and placed in the position shown. The hydraulic jack 54 is activated until the load on the hydraulic jack 54, as shown by the gauge 60, is equal to the original design load of the entire pile. Then the jack screws 36 are lengthened by rotation until the load on them is equal to the original design load of the pile 14; the hydraulic jack 48 is lowered and removed through the access opening 138, and the resulting cavity is filled through the access opening 138 with a suitable load-bearding grout, which as concrete and the access opening is then sealed by reinstallation of the access plate 130. This allows the hydraulic jack 48 to be reused on other jobs. For small piles 14 where the design load is not great, a screw jack can be used an left inside the jack section 48 permanently. The aligned apertures 122 in the upper and lower portions of the jack section 48 allow the intermediate spacer pile sections 76, 132 to be mechanically and permanently connected to the jack section 48 as described below.

Figure 13:
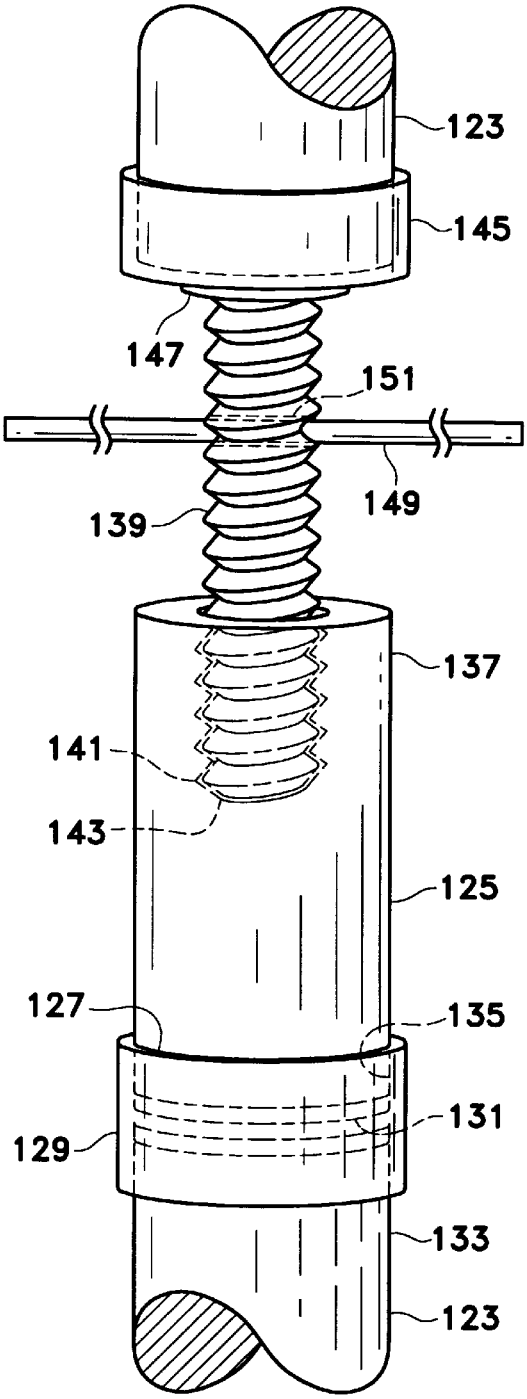
FIG. 13 is a left-hand front perspective view of a replacement pile section showing an alternative embodiment of the invention having a cushioning boot at a lower end of a replacement pile section and a screw jack installed in the upper end of the replacement pile section.

Referring now to FIG. 13, a cylindrical pile 123 includes a damaged section that has been removed as discussed above and inserted into the space thus created is a replacement pile section 125 having a cushioning boot 127 of rubber or the like having a cylindrical side wall 129 and an inner web member 131, which covers the entire cross section of the cushioning boot 127, separating the lower existing pile section 133 from the lower end 135 of the replacement pile section 125. The upper end 137 of the replacement pile section 125 includes a threaded jack screw 139 threadably received into a press fitted threaded sleeve 141 seated in the bore 143 and fixed to the lower end of an upper cushioning boot 145, into which the lower end of the upper existing pile section 123 is inserted. A free-wheeling rotational disk 147 is fixed to the upper end of the jack screw to allow for rotation of the screw 139 without rotating any other element of this system. The screw jack 139 is turned for adjustment of the length of the replacement pile section 125 by a jack handle 149 inserted through the through bore 151 in the jack screw 139. The jack may also be hydraulically actuated and this system may be used with any shape or type of pile.

Figure 14:
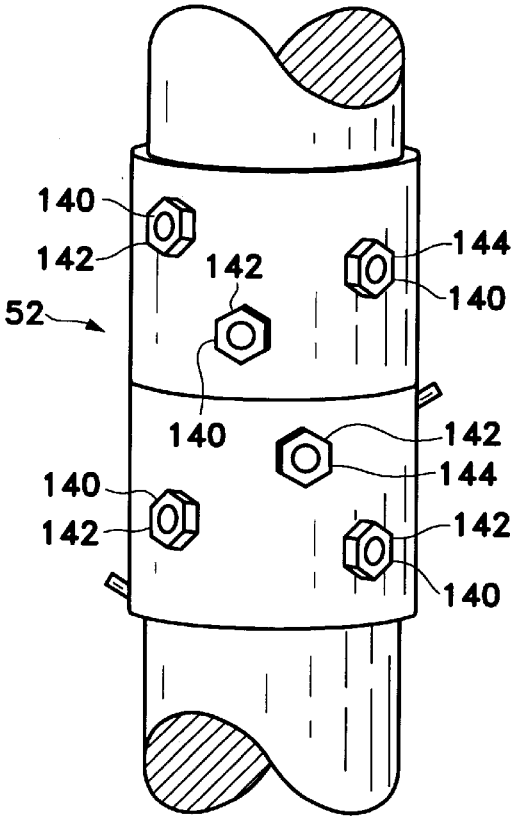
FIG. 14 is an enlarged perspective view of a coupler unit for use with wooden piles.
Figure 15:
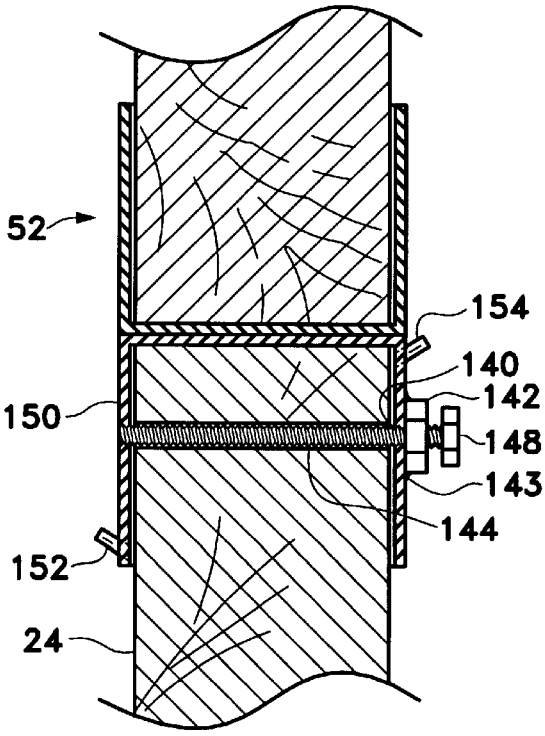
FIG. 15 is an elevation of the coupler of FIG. 14 fastened to a pile section by a plurality of locking rods.

Referring now to FIG. 14, a coupler 52 modified for use with wooden piles, which cannot be screwed or bolted, includes a number of apertures 140, with each aperture having a nut 142 welded to it with filets. Referring to FIG. 15, after the pile sections, which may be any pile described herein, such as piles 24, 26 when constructed of wood, is inserted and seated into the coupler 52, a bore 144 is formed in the pile section 14 in horizontal alignment with apertures 140. A bolt 148 is threaded through each nut 142, which is tightened until it presses firmly against the opposite side wall 150 of the coupler section 52. A lower valve opening 152 and an upper valve opening 154 allow any gaps between the coupler 52 and the pile sections 24, 26 to be filled with a suitable grout such as epoxy resins, concrete and the like.

Figure 15A:
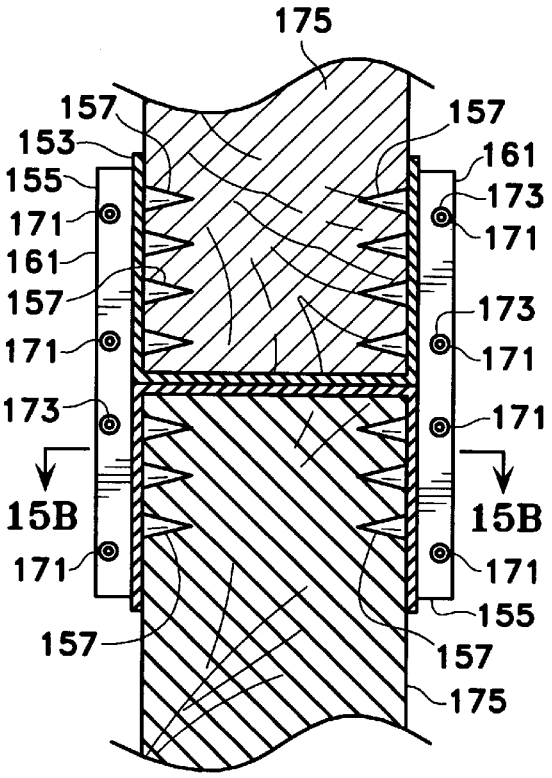
FIG. 15A is an elevation of a pile section showing an alternative embodiment of a coupler.
Figure 15B:
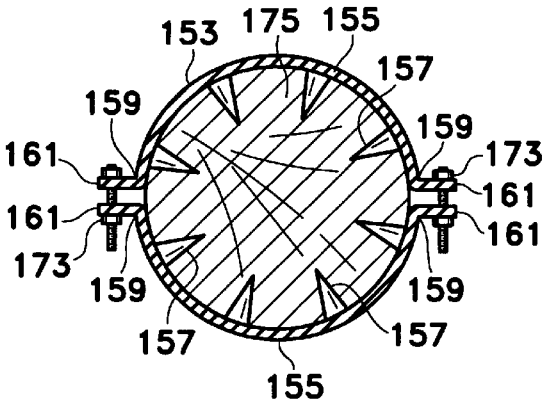
FIG. 15B is a sectional view taken along line 15B—15B of FIG. 15A.

Referring to FIGS. 15A and 15B, a coupler 153 for use with wooden piles 175 and wooden pile replacement sections 175 includes a pair of opposed semi-cylindrical coupler shells 155, each having a number of inwardly projecting spikes 157, which may be fixed to the coupler shells 155 by welding or the like, or may be formed by die cutting portions of the coupler shells 155 into triangular shapes and pushing these cut out portions inwardly until they are perpendicular to their point of contact with the coupler 153. Along both longitudinal edges 159 of each coupler shell 155 lies a flange 161 having apertures 171 therethrough, producing a row of apertures aligned along each pair of flanges 161. Each aligned aperture 163 pairs are connected by a bolt and nut 173, or other adjustable fasteners, which are tightened until the coupler shells 155 are drawn into contact with the wooden pile 175, thereby driving all the spikes 157 into the wooden pile 175. A gap remains between the flanges 161 when the coupler shells 155 are fully installed.

In using the replacement pile section 10, the damaged section of the pile 14, 15, 16 is removed and dressed, as described above, and the desired replacement pile on land, but without a hydraulic jack 48 in the jack section, which allows the pile ends 76, 132 to be butted together within the coupler 52 of the jack section 48, making the replacement pile section 10 short enough to fit between the existing pile ends 24, 26. Then the upper end 26 of the remaining pile section is lifted with a crane to create a space between the lower end 24 of the existing pile 15, 16 for insertion of the hydraulic jack 48 into the coupler 52 through the access opening 138. The hydraulic jack 48 is then activated until the motive piston 56 exerts the pile design load onto the pile ends 24, 26. Then the screws 136 are adjusted to accept the entire design load of the existing pile 14, 16; the hydraulic jack 48 is removed, and the cavity of the jack section 48 is grouted and sealed, as described above.

Referring now to FIGS. 16, 17 there is shown an alternative embodiment of the present invention illustrated in connection with an H-pile 160 that employs two or more hydraulic jacks 162, each having a piston 164 or a combination of a piston 164 and an extension member 163 longer than the replacement H-pile section 166. Each hydraulic jack 162 is seated between an upper jack seat flange 168 and a lower jack seat flange 170, which are secured to an existing H-pile section 160 by the bolts 172 or other fasteners. As seen in FIG. 16, each jack flange includes a horizontal seat plate 174 welded to a vertical reenforcing plate 176, which is fixed to the H-pile 160, and a pair of triangular gussets 178 having one leg welded to the horizontal seat plate 174 and another leg welded to the vertical reenforcing plate 176.

Each extension member 163 includes a lower base 165 welded to it and is bolted to the corresponding horizontal seat plate 174 by the bolts 172 and nuts, and an upper base 167 welded to it and is bolted to the jack base plate 169 by the bolts and nuts 172. Each hydraulic jack 162 is thus seated externally of the H-pile 160 and can easily be removed after use for use on another job. Each hydraulic jack 162 includes a pressure cylinder 180 for driving the piston 164, which may be independently actuated, or connected by hydraulic lines 180 to a hydraulic motor 58 having force sensors 60 for insuring that each hydraulic jack 162 exerts equal force on the pair of seat flanges formed by aligned pairs of jack seat flanges 168, 170. Two or more hydraulic jacks 162 are employed, with the principal requirement being to provide balanced forces on the existing H-pile sections 160 when they are being forced apart by the hydraulic jacks 162, so whatever number of jacks is used, they are equally spaced about the perimeter of the pile being repaired and are matched to provide equal force exertion on the pistons 164 during jacking.

The replacement pile section 166 is buttressed by flat steel plates 182 bolted to the flat sides of the H-pile, which are initially bolted to the upper and lower portions of the existing H-pile above and below the section to be replaced. The replacement H-pile section 166 is then lowered into place after the hydraulic jacks 162 have been installed and actuated to produce the desired load onto the existing upper and lower existing H-pile sections 160. Then a plurality of holes 184 are drilled into the replacement H-pile section 166 in alignment with the pre-drilled holes 184 in the flat steel plates 182 and these members are permanently connected with bolts and nuts 172. Then the hydraulic jacks 162 are removed for use on other jobs.

The system and process described in connection with H-piles in FIGS. 16, 17 can be used with any other type of pile, regardless of the material the pile or replacement pile section is made from. In some cases it may be necessary to utilize a fastening system other than bolts.

The replacement pile section 10, 166 is pre-treated before installation by coating with epoxy resins, other resins, or other coating to prevent corrosion or other deterioration.

Using the system disclosed herein, the replacement pile section can be made from any desired piling material, such as wood, concrete, steel, and the like, without regard to the material the original pile is made from. In some applications, for example, it may be desired to replace a damaged section of a wooden pile with a steel pile to improve resistance to side impacts or boring marine animals.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A process for replacing a damaged section of a pile supporting a load comprising the steps of:

a. removing a damaged section of an existing pile, thereby creating at least a lower end of said existing pile and an upper load bearing structure;

b. installing a replacement pile section between said lower end of said existing pile and said upper load bearing structure;

c. installing at least one hydraulic jack inside a hollow portion of said replacement pile section for exerting tension forces along a line parallel with said pile between said lower end of said existing pile and said load bearing structure; and d. exerting a tension force along said parallel line.

2. A process in accordance with claim 1 wherein said step d further comprises monitoring said tension force until said force reaches a predetermined value.

3. A process in accordance with claim 1 comprising the additional step a-1 of fixing a coupler onto said lower end of said existing pile carried out between step a and step b.

4. A process in accordance with claim 3 comprising the additional step b-1 of fixing said replacement pile section to said lower end of said existing pile and said upper load bearing structure.

5. A process in accordance with claim 3 wherein said step a-1 further comprises the step of dressing said existing pile lower end into a desired shape prior to the step of fixing said coupler into place.

6. A process in accordance with claim 1 further comprising the additional step e of filling said hollow portion of said replacement pile section with grout.

7. A process in accordance with claim 1 further comprising a final step of inserting a means for absorbing shock between said lower end of said existing pile and said replacement pile section.

8. A process in accordance with claim 7 wherein said final step of inserting said shock absorbing means comprises the step of inserting a hydraulic fluid flow shock absorber.

9. A process in accordance with claim 7 wherein said final step of inserting said shock absorbing means comprises the step of inserting a compression spring.

10. A process in accordance with claim 7 wherein said final step of inserting said shock absorbing means comprises the step of inserting a solid elastic resilient material.

11. A process for repairing a pile system supporting a structure comprising the steps of:

a. selecting piles having damaged sections;

b. determining the number and pattern of said damaged piles that may be removed while maintaining the dead load capacity of said pile system;

c. removing said determined damaged sections of said piles, thereby creating a plurality of lower ends and a plurality of load bearing structures of each of said piles; and d. installing at least one hydraulic jack for exerting tension forces along a line parallel with at least one of said piles at time between said lower end of said existing pile and said load bearing structure and replacing each of said removed pile sections with a replacement pile section.

12. A process in accordance with claim 11 wherein said step d further comprises monitoring said tension force until said force reaches a predetermined value.

13. A process in accordance with claim 11 comprising the further step of removing said at least one hydraulic jack.

14. A process for replacing a section of an H-pile comprising the steps of:

a. installing an upper jack seat flange on each flat side of an upper existing H-pile segment and a lower jack seat flange onto each flat side of a lower existing H-pile segment resulting in aligned upper and lower jack seat flanges on each flat side of the H-pile such that said upper and lower jack seat flanges bracket a section of the H-pile to be replaced;

b. installing at least one hydraulic jack between each pair of said upper jack seat flanges and said lower jack flanges;

c. actuating said hydraulic jacks to carry the load of said H-pile;

d. removing said section of the H-pile to be removed;

e. installing a replacement H-pile section;

f. deactuating said hydraulic jacks; and g. removing said hydraulic jacks.

15. A process in accordance with claim 14 further comprising in step d the step of equalizing the force exerted by each said hydraulic jack.

16. A process in accordance with claim 14 further comprising the in step f the additional step of securing said replacement H-pile section adjacent to said existing upper and lower existing H-pile segments.

* * * * *